US007082776B2

(12) United States Patent
Shin

(10) Patent No.: US 7,082,776 B2
(45) Date of Patent: Aug. 1, 2006

(54) APPARATUS AND METHOD FOR CONTROLLING COLD AIR CIRCULATION IN REFRIGERATOR

(75) Inventor: Jun-Chul Shin, Inchun (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/470,901

(22) PCT Filed: Apr. 3, 2002

(86) PCT No.: PCT/KR02/00589

§ 371 (c)(1),
(2), (4) Date: Aug. 1, 2003

(87) PCT Pub. No.: WO02/081987

PCT Pub. Date: Oct. 17, 2002

(65) Prior Publication Data

US 2004/0216476 A1 Nov. 4, 2004

(30) Foreign Application Priority Data

Apr. 7, 2001 (KR) ..... 2001-18486
Apr. 7, 2001 (KR) ..... 2001-18488

(51) Int. Cl.
*F25D 17/04* (2006.01)

(52) U.S. Cl. ..... 62/186; 62/126

(58) Field of Classification Search ..... 62/186, 62/155, 156, 231, 199, 126
See application file for complete search history.

(56) References Cited

U.S. PATENT DOCUMENTS 4,726,160 A * 2/1988 Kawaguchi et al. ..... 62/157
4,732,014 A 3/1988 Frohbieter
5,212,962 A 5/1993 Kang et al.
5,729,997 A 3/1998 Witsoe (Continued)

FOREIGN PATENT DOCUMENTS

JP 04-295580 10/1992

(Continued)

OTHER PUBLICATIONS

European Search Report dated Aug. 17, 2005.

*Primary Examiner*—Chen-Wen Jiang
(74) *Attorney, Agent, or Firm*—Fleshner & Kim, LLP

(57) ABSTRACT

The present invention relates to an apparatus and method for controlling cold air circulation in a refrigerator. The present invention re-circulates cold air, which has been discharged into a refrigerating chamber (35), so that the interior of the refrigerating chamber (35) can be maintained at a substantially uniform temperature and relatively low temperature cold air is prevented from being delivered to an evaporator (39). Particularly, the present invention further facilitates the cold air circulation at a lower portion of the refrigerating chamber (35) so that the temperature of the entire refrigerating chamber (35) can be kept to be uniform and the temperature of a vegetable storage chamber (36) can be set at a desired temperature. To this end, an embodiment of the present invention includes a circulation duct (50) configured to suck the cold air around the vegetable storage chamber (36) and to discharge it to a relatively upper portion of the refrigerating chamber (35). An inlet (51) of the circulation duct (50) is installed in vicinity of a reward lower portion of the vegetable storage chamber (36), and an outlet of the circulation duct (50) is open to above a shelf (35') corresponding to a top end of the vegetable storage chamber (36). Further, a circulation fan (54) is installed at the outlet (52).

23 Claims, 6 Drawing Sheets

U.S. PATENT DOCUMENTS 6,119,468 A * 9/2000 Seok ..... 62/89
6,138,460 A * 10/2000 Lee ..... 62/89

FOREIGN PATENT DOCUMENTS

JP 05-093571 4/1993
JP 2000-088422 3/2000
JP 2000081264 A * 3/2000
KR 61-228277 10/1986
KR 3-134465 6/1991
KR 5-93571 4/1993
KR 1997-0011705 3/1997
KR 1020000051790 8/2000

* cited by examiner

APPARATUS AND METHOD FOR CONTROLLING COLD AIR CIRCULATION IN REFRIGERATOR

BACKGROUND OF THE INVENTION

1. Field of the Invention

The present invention relates to a refrigerator, and more particularly, to an apparatus for controlling cold air circulation in a refrigerator, which allows the internal temperature throughout a refrigerating chamber of the refrigerator to be uniformly distributed.

2. Description of the Prior Art

FIG. 6 shows a sectional view of a refrigerator which employs a conventional apparatus for controlling cold air circulation therein. As shown in this figure, a freezing chamber 3 and a refrigerating chamber 5, which are-storage spaces formed in the interior of a main body 1 of the refrigerator, are separated from each other by a barrier 4. A plurality of shelves 5' are installed at different levels in the refrigerating chamber 5 so that stored goods can be put on the shelves. A vegetable storage chamber 6 for separately storing fruits or vegetables therein is formed at a lowermost portion of the refrigerating chamber 5. In general, the vegetable storage chamber 6 is constructed in the form of a drawer.

The freezing chamber 3 and the refrigerating chamber 5 are opened and closed by doors 7, 7', respectively, so as to communicate with the exterior thereof Inner surfaces of the doors 7, 7' are provided with door baskets 8 for accommodating stored goods.

Meanwhile, an evaporator 9, which is one of constituent components of a heat exchange cycle for generating cold air to circulate in the refrigerator, is installed in the rear of the freezing chamber 3. A space in which the evaporator 9 is installed is shielded by a shroud 10. A grill fan 12 is mounted between the shroud 10 and the freezing chamber 3. Further, in order to circulate the cold air generated by the evaporator 9, a blower fan 14 is installed above the evaporator 9. The blower fan 14 causes the cold air to flow into a space between the shroud 10 and the grill fan 12. The grill fan 12 is also provided with a discharge port (not shown) through which the cold air is discharged to the freezing chamber 3.

Moreover, the cold air which has flowed downward through between the shroud 10 and the grill fan 12 is supplied to the refrigerating chamber 5 through the barrier 4. To this end, a refrigerating chamber duct 16 is installed in the rear of the refrigerating chamber 5 such that it extends lengthily from an upper end of the refrigerating chamber to a lower end thereof The refrigerating chamber duct 16 is formed with cold air discharge ports 17 through which the cold air is discharged to spaces partitioned by the shelves 5'.

Then, a freezing chamber return flow passage 18 is formed such that the freezing chamber 3 communicates with the space with the evaporator 9 installed therein through a top surface of the barrier 4 corresponding to a floor of the freezing chamber 3. The cold air which has circulated in the freezing chamber 3 is returned to the evaporator 9 through the freezing chamber return flow passage 18. Further, a refrigerating chamber return flow passage 19 is formed such that the refrigerating chamber 5 communicates with the space with the evaporator 9 installed therein through a bottom surface: of the barrier 4 corresponding to a ceiling of the refrigerating chamber 5.

However, there are the following problems in the conventional apparatus for controlling the cold air circulation constructed as such.

In the prior art, as a refrigeration cycle is operated and the blower fan 14 is also driven, the cold air which has circulated in the refrigerating chamber 5 is delivered through the refrigerating chamber return flow passage 19 to the evaporator 9 where heat exchange occurs, and then circulates in the refrigerator. Therefore, during the driving of the refrigeration cycle, the temperature of the refrigerating chamber 5 is relatively lowered since a great deal of cold air is delivered to the refrigerating chamber 5. On the contrary, when the refrigeration cycle is stopped, the temperature of the refrigerating chamber 5 is rapidly increased in a state where there is no cold air flow. In such a way, if the cold air flow varies depending on the turning-on/off of the refrigeration cycle, the temperature deviation in the refrigerating chamber 5 becomes larger. Consequently, freshness of the stored goods is deteriorated.

Particularly, the cold air supplied to the refrigerating chamber 5 through the refrigerating chamber duct 16 is relatively less influenced by the blower fan 14. Further, the cold air is relatively less delivered to the door baskets 8 spaced far apart from the discharge port 17. Thus, the temperatures of the door baskets 8 are relatively higher than those in the shelves 5' located at the same levels as the baskets 8. Such a phenomenon becomes severest at a position corresponding to the position of the vegetable storage chamber 6, which is a position of the lowermost one of the door baskets 8.

Moreover, an actual temperature of the vegetable storage chamber 6 is relatively higher than an optimum temperature therein. This is because there is a relatively little amount of cold air which flows toward a lower portion of the refrigerating chamber duct 16 and is then delivered to the vegetable storage chamber 6. That is, according to the prior art, the cold air is not uniformly delivered to the entire refrigerating chamber 5. Thus, it is likely that the temperature of a lower portion of the refrigerating chamber 5 becomes relatively higher, whereas the temperature of an upper portion of the refrigerating chamber 5 becomes relatively lower.

Thus, there are disadvantages as described below. Since the temperature of the refrigerating chamber 5 is not uniformly set in such a way, the freshness of foodstuffs stored in the lower portion of the refrigerating chamber 5 is deteriorated. In addition since the cold air in the upper, portion of the refrigerating chamber 5 is returned to the evaporator 9 in a state where the cold air is at a relatively lower temperature, heat loss occurs in the evaporator 9.

SUMMARY OF THE INVENTION

Therefore, the present invention is conceived to solve the aforementioned problems in the prior art. An object of the present invention is to minimize temperature deviation in a refrigerating chamber of a refrigerator.

Another object of the present invention is to precisely maintain the temperature of a vegetable storage chamber installed at a lower portion of the refrigerating chamber of the refrigerator.

A further object of the present invention is to minimize heat loss of cold air which is returned from the refrigerating chamber to an evaporator.

According to an aspect of the present invention for achieving the above objects, there is provided an apparatus for controlling cold air circulation in a refrigerator, comprising a cold air supply means for supplying cold air, which has been generated by a heat exchanger, to a storage space by using a blower fan; a cold air supply flow passage with a plurality of cold air discharge ports corresponding to respective portions of the storage space so that the cold air supplied from the cold air supply means is delivered to the storage space; a cold air return flow passage for returning the cold air, which has circulated in the storage space, to the heat exchanger by means of suction force of the blower fan; a cold air circulation means for causing the cold air, which has been supplied from the cold air supply flow passage to the storage space, to flow from a lower portion of the storage space to a relatively upper portion thereof; and a microcomputer for controlling the cold air supply means and the cold air circulation means based on information on temperature of the storage space so as to circulate the cold air in the refrigerator.

The cold air circulation means preferably comprises a circulation fan for sucking the cold air at the lower portion of the storage space, and a circulation duct of which an inlet is disposed at the lower portion of the storage space and an outlet is disposed at the relatively upper portion of the storage space so as to deliver the cold air sucked by the circulation fan into the storage space again.

The circulation fan may be installed at the outlet or inlet of the circulation duct.

The cold air circulation means may be installed within the cold air supply flow passage, or at a side wall of the storage space which is separate from the cold air supply flow passage.

The outlet of the circulation duct is preferably installed at the cold air discharge port of the cold air supply flow passage, and the inlet of the circulation duct is preferably positioned at a relatively lower portion of the storage space.

The inlet of the circulation duct is preferably configured to communicate with a lower portion of an auxiliary storage chamber which is separately formed at the lower portion of the storage space.

According to another aspect of the present invention, there is provided a method for controlling cold air circulation in a refrigerator including a blower fan for circulating cold air, which has been generated by a heat exchanger, in a storage space and a circulation fan for circulating the cold air from a relatively lower portion of the storage space to a relatively upper portion thereof, comprising the steps of determining, by a microcomputer, driving of the blower fan and the circulation fan through comparison of a sensed temperature of the storage space with a predetermined temperature; driving the blower fan based-on the determination of the microcomputer and delivering the cold air, which has been generated by the heat exchanger, into the storage space; and stopping the blower fan based on the determination of the microcomputer and circulating the cold air, which has been delivered into the storage space, from the lower portion to the upper portion of the storage space by using the circulation fan.

BRIEF DESCRIPTION OF THE DRAWINGS

The above and other objects, features and advantages of the invention will become more apparent from reading the following description of preferred embodiment taken in connection with the accompanying drawings in which.

DETAILED DESCRIPTION OF THE INVENTION

Hereinafter, preferred embodiments of an apparatus and method for controlling cold air circulation in a refrigerator according to the present invention will be described in detail with reference to the accompanying drawings.

Figure 1:
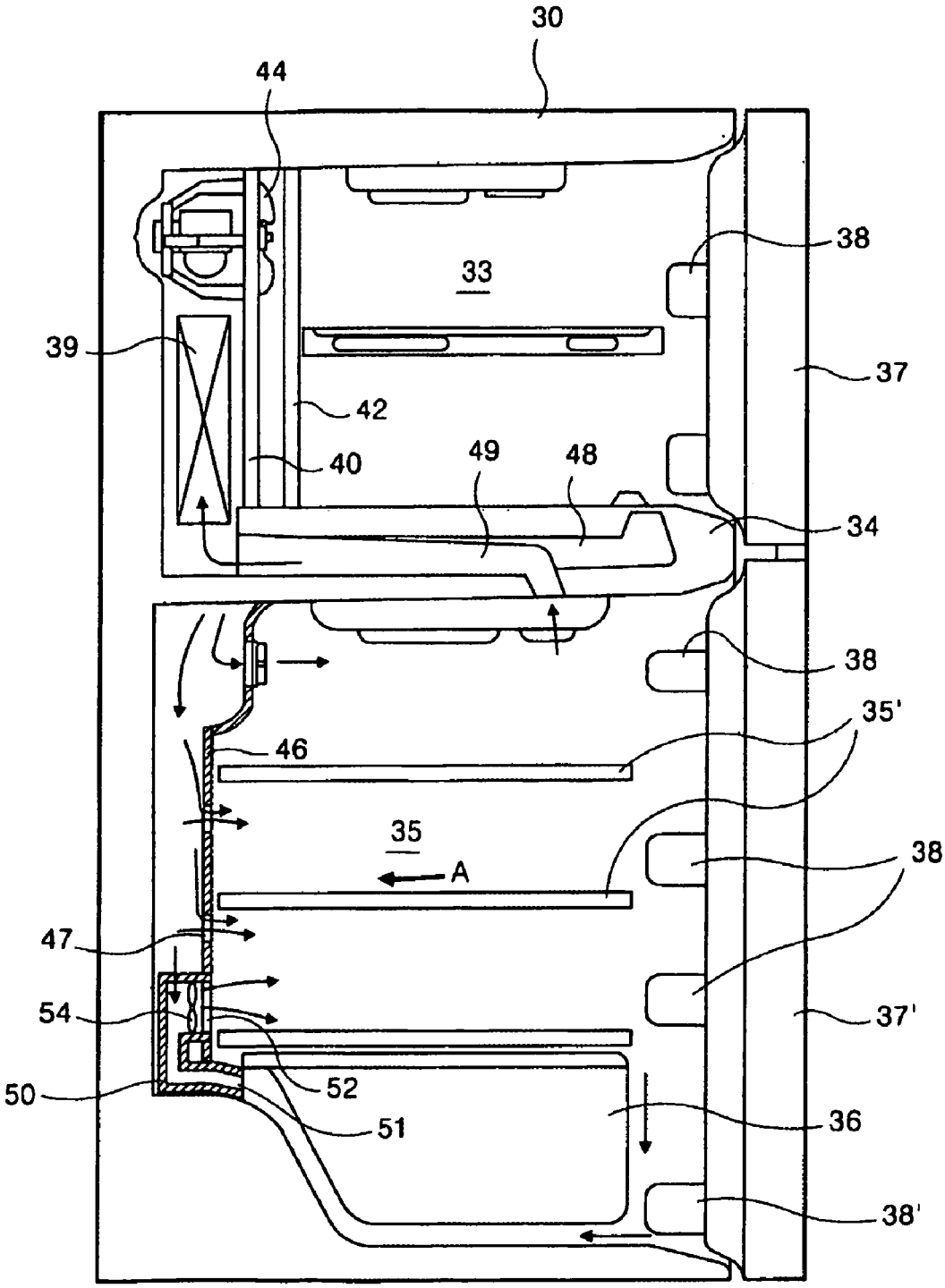
FIG. 1 is a sectional view showing the constitution of a refrigerator which employs a preferred embodiment of an apparatus for controlling cold air circulation in the refrigerator according to the present invention.
Figure 2:
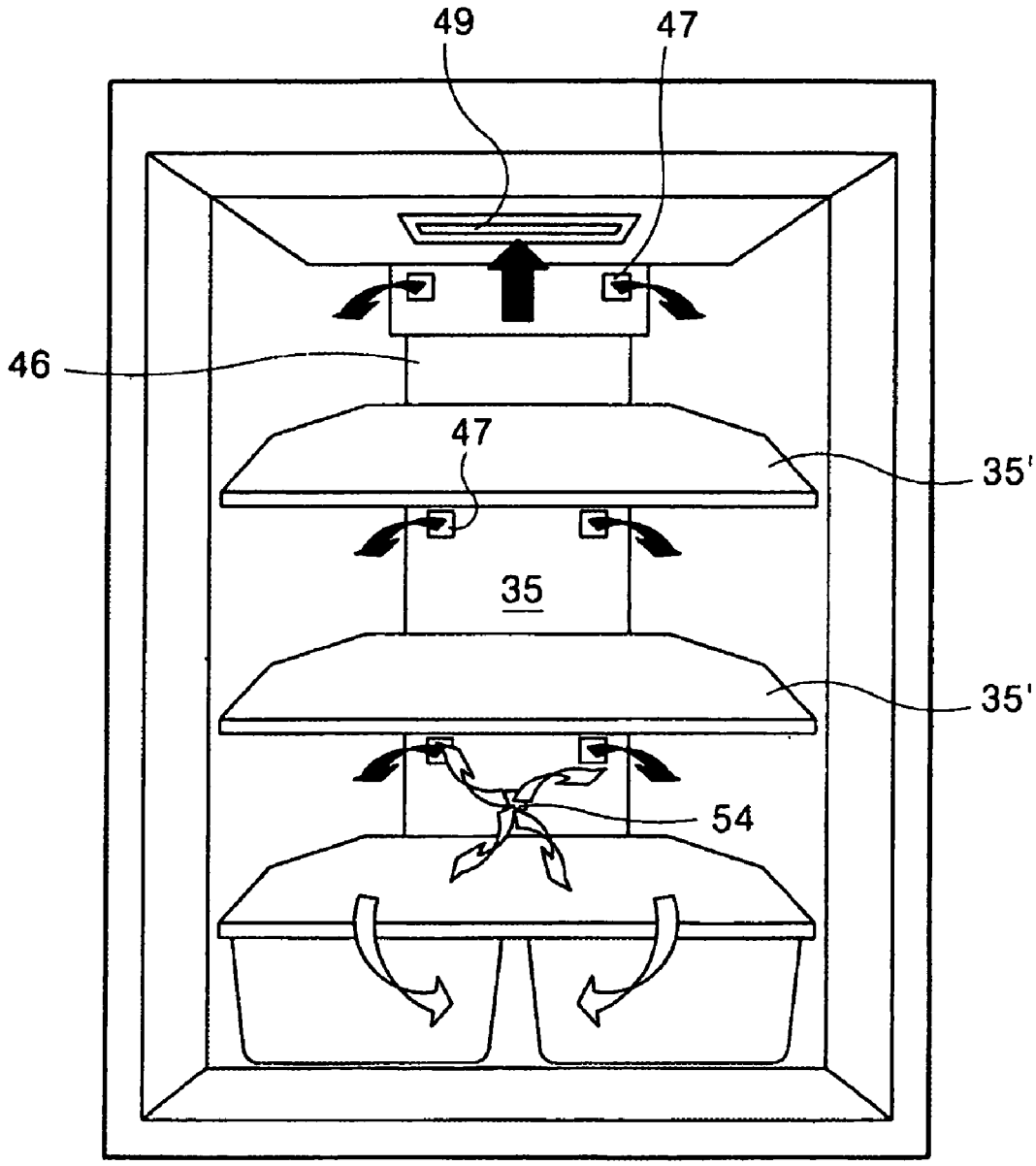
FIG. 2 is a front perspective view showing the constitution of a, refrigerating chamber according to the embodiment shown in FIG. 1.

First, referring to FIGS. 1 and 2, one embodiment of the present invention will be described. As shown in these figures, the interior of a main body 30 of a refrigerator, which is comprised of walls having insulation layers, is provided with a freezing chamber 33 and a refrigerating chamber 35 as storage spaces. The freezing chamber 33 and the refrigerating chamber 35 are separated by a barrier 34 so that the freezing chamber 33 and the refrigerating chamber 35 are disposed at upper and lower portions of the main body, respectively.

A plurality of shelves 35' are installed in the refrigerating chamber 35 so that stored goods can be put thereon. A vegetable storage chamber 36 as an auxiliary storage space, which is separately formed by means of partitions so as to store fruits or vegetables, is installed at a lower portion within the refrigerating chamber 35.

The freezing chamber 33 and the refrigerating chamber 35 selectively communicate with the outside environment of the refrigerator by doors 37, 37', respectively. Inner surfaces of the doors 37, 37' are provided with a plurality of door baskets 38 for accommodating stored goods.

Meanwhile, an evaporator 39 as a heat exchanger, which constitutes a refrigeration cycle, is installed in the rear of the freezing chamber 33 in order to generate cold air to circulate in the refrigerator. A space between the evaporator 39 and the freezing chamber 33 is partitioned by a shroud 40 and a grill fan 42. A space between the shroud 40 and the grill fan 42 serves to distribute the cold air to the freezing chamber 33 and the refrigerating chamber 35. Here, the grill fan 42 is formed with a plurality of discharge ports (not shown) through which the cold air is supplied to the freezing chamber 33. Further, a blower fan 44 which provides driving force for causing the cold air to flow in the refrigerator is installed above the evaporator 39.

In order to supply the cold air into the refrigerating chamber 35, a refrigerating chamber duct 46 is installed in the rear of the refrigerating chamber 35. The refrigerating chamber duct 46 extends lengthily from an upper end of the refrigerating chamber to a lower end thereof, and is formed with cold air discharge ports 47 to correspond to the respective shelves 35'. The cold air is delivered as far as the vegetable storage chamber 36 through the refrigerating chamber duct 46.

In order to return the cold air, which has circulated in the freezing chamber 33, to the evaporator 39, a freezing chamber return flow passage 48 is formed through the interior of the barrier 34. Furthermore, in order to return the cold air, which has circulated in the refrigerating chamber 35, to the evaporator 39, a refrigerating chamber return flow passage 49 is formed through the interior of the barrier 34. An inlet of the refrigerating chamber return flow passage 49 is formed on a bottom surface of the barrier 34 which becomes a ceiling of the refrigerating chamber 35.

Meanwhile, a circulation duct 50 is provided for further facilitating the cold air circulation in the lower portion of the refrigerating chamber 35. Although the circulation duct 50 is installed in the refrigerating chamber duct 46 in this embodiment, it is not necessarily limited thereto. The circulation duct 50 may be installed at a location, such as both side walls of the refrigerating chamber 35, separate from the refrigerating chamber duct 46.

An inlet 51 of the circulation duct 50 is disposed at a rearward lower end of the vegetable storage chamber 36 to communicate with a lower portion of the vegetable storage chamber 36. An outlet 52 of the circulation duct 50 is disposed to be open to above a shelf 35' which is placed at a top end of the vegetable storage chamber 36. At this time, the outlet 52 is installed to penetrate through a portion of a front surface of the refrigerating chamber duct 46. The outlet 52 is also formed to communicate with the refrigerating chamber 35 via the cold air discharge port 47.

Further, the outlet 52 of the circulation duct 50 is provided with a circulation fan 54 for circulating the cold air through the circulation duct 50. The circulation fan 54 causes the cold air, which has been sucked through the inlet 51, to be discharged into the refrigerating chamber 35 through the outlet 52.

In the meantime, it is preferred that temperature sensors (not shown) be mounted so as to sense the temperatures within the refrigerating chamber 35, the vegetable storage chamber 36 and the like. Information on the temperature sensed by the temperature sensors are transmitted to a microcomputer (not shown) and then used for determination of the driving of the refrigeration cycle (i.e., driving of the blower fan 44) and the driving of the circulation fan 54. The microcomputer determines the driving of the blower fan 44 and the circulation fan 54 based on predetermined data and the information on the temperature sensed by the temperature sensors.

Hereinafter, the operation of the present embodiment having the aforementioned constitution will be described.

First of all, the cold air circulation performed in the refrigerator will be explained. When the refrigeration cycle is operated, a compressor (not shown) is driven and a refrigerant moves along the refrigeration cycle. Then, a relatively low temperature refrigerant is supplied to the evaporator 39 to generate the cold air.

The cold air generated by the evaporator 39 circulates in the refrigerator by means of the blower fan 44. That is, the cold air is delivered to the space between the shroud 40 and the grill fan 42 by the driving of the blower fan 44, and then, a portion of the cold air is delivered to the freezing chamber 33 through the discharge ports of the grill fan 42. The remainder of the cold air flows downward in the space between the shroud 40 and the grill fan 42, passes through the barrier 34 and is supplied to the refrigerating chamber duct 46.

The cold air delivered to the refrigerating chamber duct 46 flows downward along the refrigerating chamber duct 46 and is simultaneously discharged through the respective discharge ports 47 to above the respective shelves 35' in the refrigerating chamber 35. The discharged cold air cools the stored goods within the refrigerating chamber 35.

Then, the cold air which has been delivered to the freezing chamber 33 and the refrigerating chamber 35 is returned to the evaporator 39 through the freezing chamber return flow passage 48 and the refrigerating chamber return flow passage 49, respectively. Heat exchange occurs between the cold air and the refrigerant in the evaporator, and the cold air then repeatedly circulates in the refrigerator.

Meanwhile, the circulation fan 54 sucks the cold air on a side of the lower portion of the refrigerating chamber 35 and discharges it upward. It is preferred that the circulation fan 54 be driven when the blower fan 44 is not operated. This is to prevent the vegetable storage chamber 36 from being cooled too excessively due to continuous supply of the cold air, which is supplied from the evaporator 39 by the operation of the blower fan 44, to around the vegetable storage chamber 36.

Once the temperature of the refrigerating chamber 35 reaches a predetermined temperature, the operation of the heat exchange cycle is stopped and the operation of the blower fan 44 is also stopped. It is preferable to operate the circulation fan 54 in this condition.

Namely, when the circulation fan 54 is operated, the cold air at the rearward lower end of the vegetable storage chamber 36 is sucked through the inlet 51 of the circulation duct 50. Then, the sucked cold air is discharged to above the shelf 35' placed at the top end of the vegetable storage chamber 36 through the outlet 52 of the circulation duct 50. With such circulation, a space between a leading end of the vegetable storage chamber 36 and the door 37' is supplied with the cold air from the upper portion of the refrigerating chamber 35. Here, the cold air delivered from the upper portion of the refrigerating chamber 35 passes through around the vegetable storage chamber 36 and is sucked into the inlet 51 of the circulation duct 50. This cold air circulation is indicated by arrows in FIGS. 1 and 2.

In such a way, the relatively low temperature cold air can be delivered particularly to around the vegetable storage chamber 36 as well as the door baskets 38' of the door 37'. Further, the relatively low temperature cold air can also be delivered to a lowermost door basket 38' of the door 37' which otherwise might have a highest temperature. Thus, the lowermost basket 38' can be set at a desired temperature.

Such an operation of the circulation fan 54 can be controlled based on sensed signals detected by a temperature sensor additionally installed in the vegetable storage chamber 36. That is, when the temperature of the vegetable storage chamber 36 reaches a predetermined temperature, the circulation fan 54 is stopped in response to the sensed signals detected by the temperature sensor.

Next, another embodiment of the present invention is shown in FIGS, 3 and 4. When describing the constitution of this embodiment, only elements different from those of the previous embodiment shown in FIG. 1 will be described and like or similar elements are denoted by the same reference numerals as FIG. 1.

In order to further facilitate the cold air circulation in the refrigerating chamber 35, the present embodiment employs a circulation duct 150. The circulation duct 150 of the present embodiment is not also necessarily installed in the refrigerating chamber duct 46 and may be installed at a location, such as both the side walls of the refrigerating chamber 35, separate from the refrigerating chamber duct 46.

A circulation fan 152 is installed at an inlet 151 which is disposed at a lower end of the circulation duct 150. The inlet 151 of the circulation duct 150 is fitted into and installed at a circulation inlet 47' of the refrigerating chamber duct 46.

Thus, the circulation fan 152 is positioned inside the circulation inlet 47' so that the cold air within the refrigerating chamber 35 can be sucked thereinto.

The circulation duct 150 is installed in the refrigerating chamber duct 46 to extend lengthily in an up and down direction and is provided with respective outlets 154 at locations corresponding to the discharge ports 47 formed in the refrigerating chamber duct 46. The outlets 154 are formed at the locations corresponding to the discharge ports 47 so that the cold air flowing through the circulation duct 150 can be supplied to the refrigerating chamber 35 through the discharge ports 47. At this time it is preferable to make cross-sectional areas of the outlets 154 smaller than those of the discharge ports 47. Further, although each outlet 154 can be installed to be fitted into a portion of each discharge port 47, it is not necessarily limited thereto. The outlets 154 may be arranged to be disposed in the vicinity of the discharge ports 47 in the same way as the illustrated embodiment.

Hereinafter, the operation of the present embodiment as constructed as such will be briefly described. The present embodiment is the same as the previous embodiment in that the cold air generated by the evaporator 39 is delivered to the freezing chamber 33 and the refrigerating chamber 35 by means of the blower fan 44, and in that the cold air delivered to the freezing chamber 33 and the refrigerating chamber 35 is returned through the respective freezing chamber return flow passage 48 and refrigerating chamber return flow passage 49 to the evaporator 39 where the heat exchange occurs between the cold air and the refrigerant in the evaporator and then repeatedly circulates in the refrigerator.

Meanwhile, the circulation fan 152 sucks the cold air on a side of the interior of the refrigerating chamber 35 and then discharges it to the other side. It is preferable to drive the circulation fan 152 when the blower fan 44 is not operated. Alternatively, the circulation fan 152 may be driven together with the blower fan 44 so that the relatively low temperature cold air cannot be returned to the evaporator 39.

Once the temperature of the refrigerating chamber 35 reaches a predetermined temperature, the operation of the heat exchange cycle is stopped and the operation of the blower fan 44 is also stopped. It is preferable to operate the circulation fan 152 in this condition.

That is, the temperatures in the vicinity of the lower portion and the vegetable storage chamber 36 of the refrigerating chamber 35 are generally higher than the predetermined temperature. This is because the lower portion and the vegetable storage chamber 36 of the refrigerating chamber 35 are portions corresponding to a distal end of the refrigerating chamber duct 46.

Figure 3:
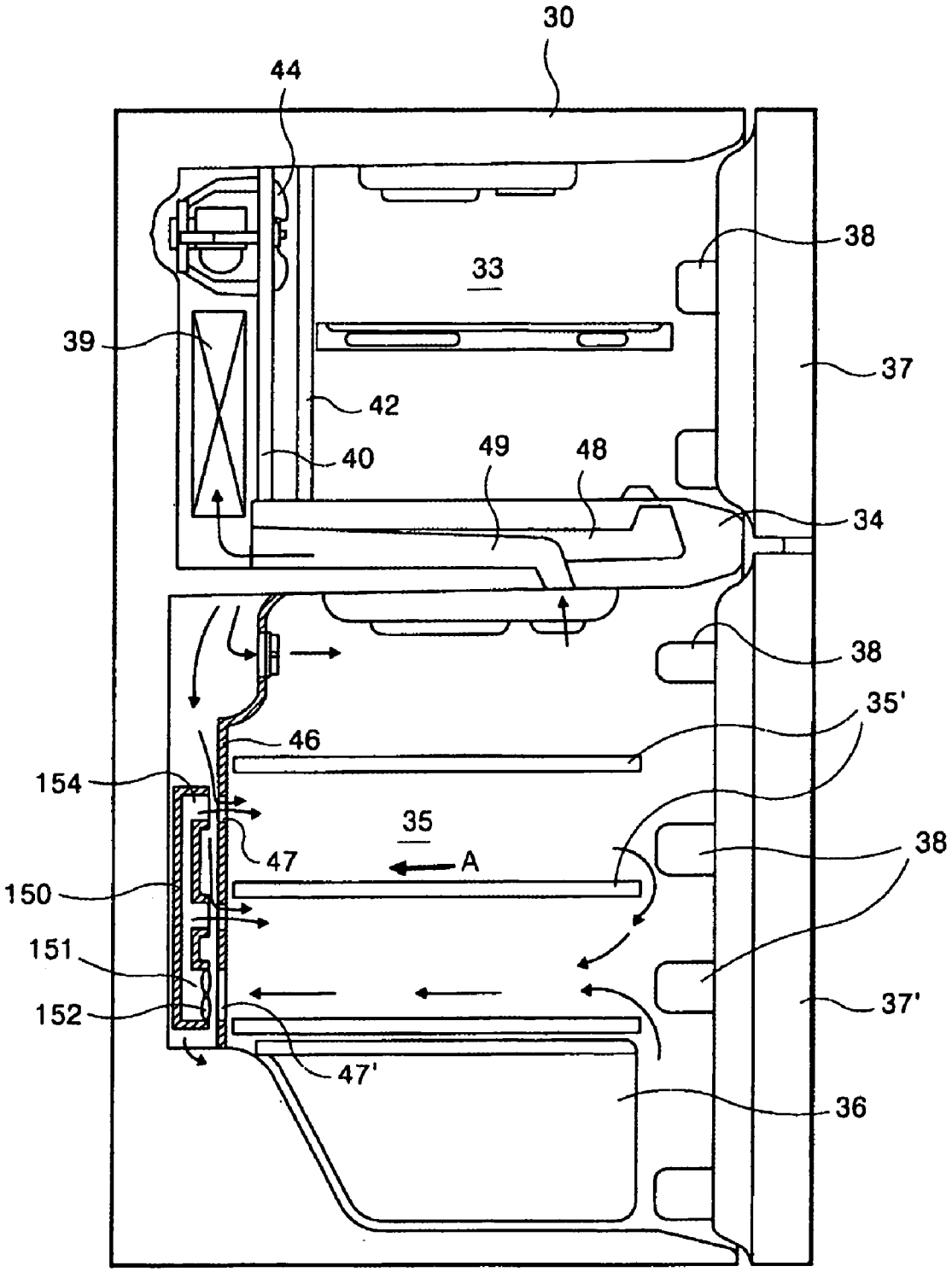
FIG. 3 is a sectional view showing the constitution of a refrigerator which employs another preferred embodiment of the present invention.
Figure 4:
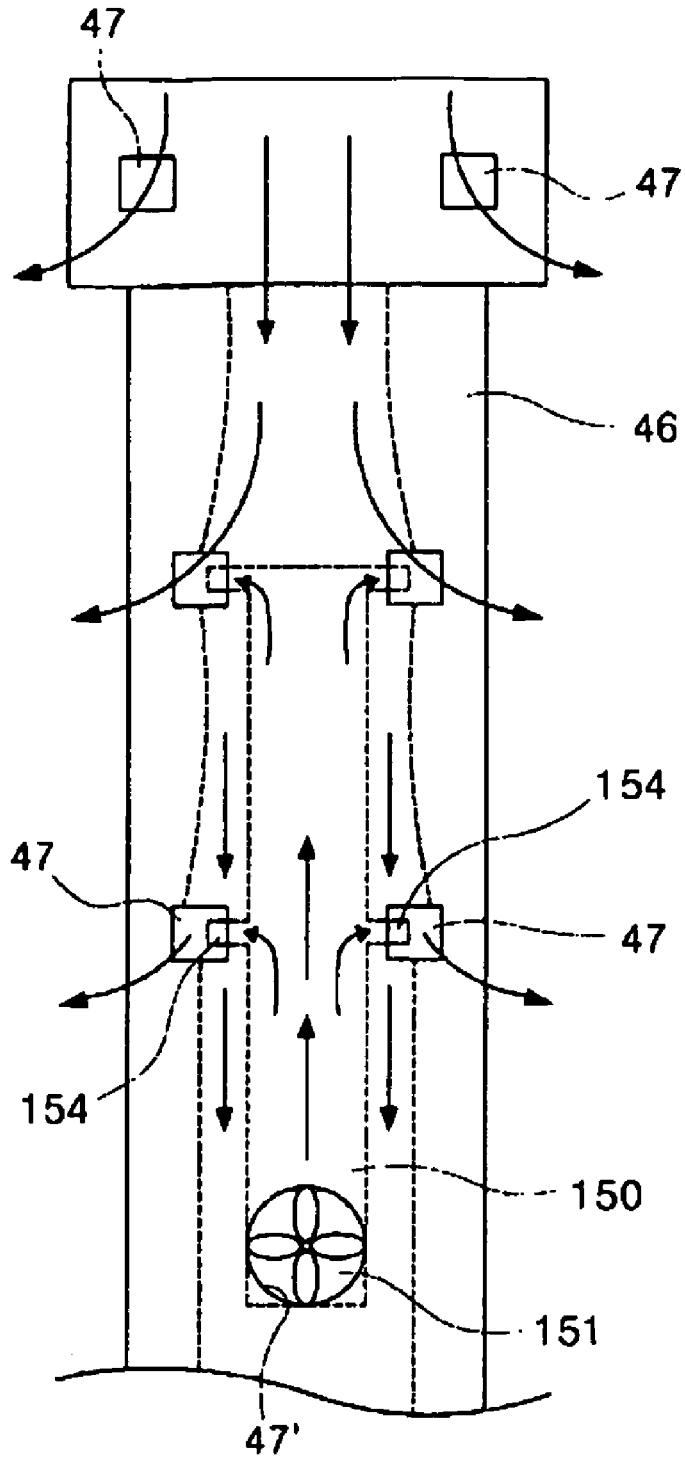
FIG. 4 is a partial front view showing the interior of the refrigerating chamber, when viewed in a direction indicated by an arrow A in FIG. 3.

Therefore, when the circulation fan 152 is operated, the cold air flow indicated by arrows in FIGS. 3 and 4 is generated within the refrigerating chamber 35. With such cold air flow, the entire interior of the refrigerating chamber 35 can be kept at a uniform temperature.

In other words, when the circulation fan 152 is operated, the cold air at the lower portion of the refrigerating chamber 35 is sucked into the circulation duct 150 through the circulation inlet 47'. Then, the sucked cold air is delivered to an upper portion of the circulation duct 150 and discharged to a relatively upper portion of the refrigerating chamber 35 through the respective outlets 154.

In particular, the cold air around the vegetable storage chamber 36 is sucked into the circulation duct 150 by means of the driving of the circulation fan 152 and the cold air at the upper portion of the refrigerating chamber 35 is simultaneously moved downward, so that the temperature of the entire refrigerating chamber 35 can be kept to be uniform.

Figure 5:
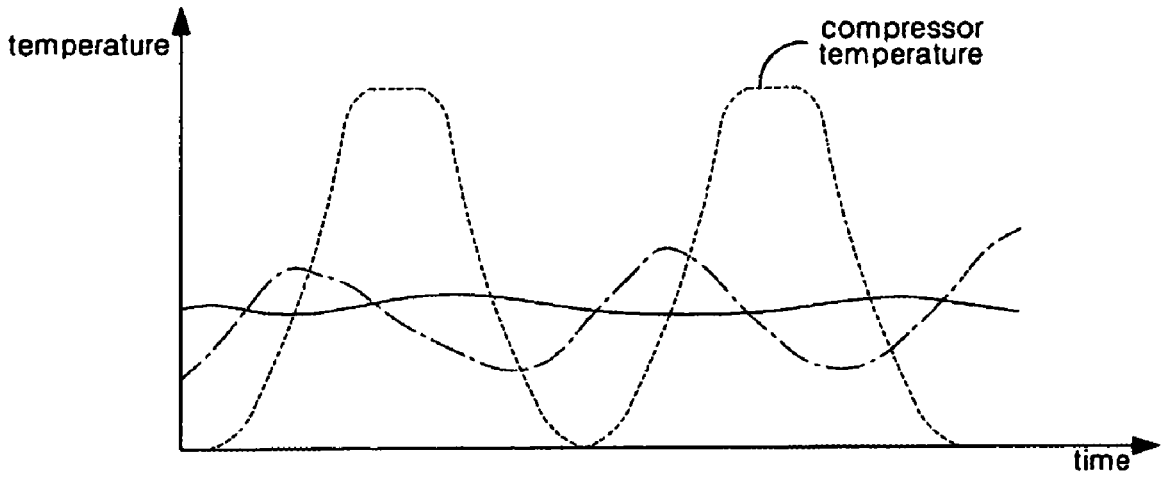
FIG. 5 is a graph showing the temperature of the refrigerating chamber depending on the temperature of a compressor in the apparatus for controlling the cold air circulation according to the present invention.
Figure 6:
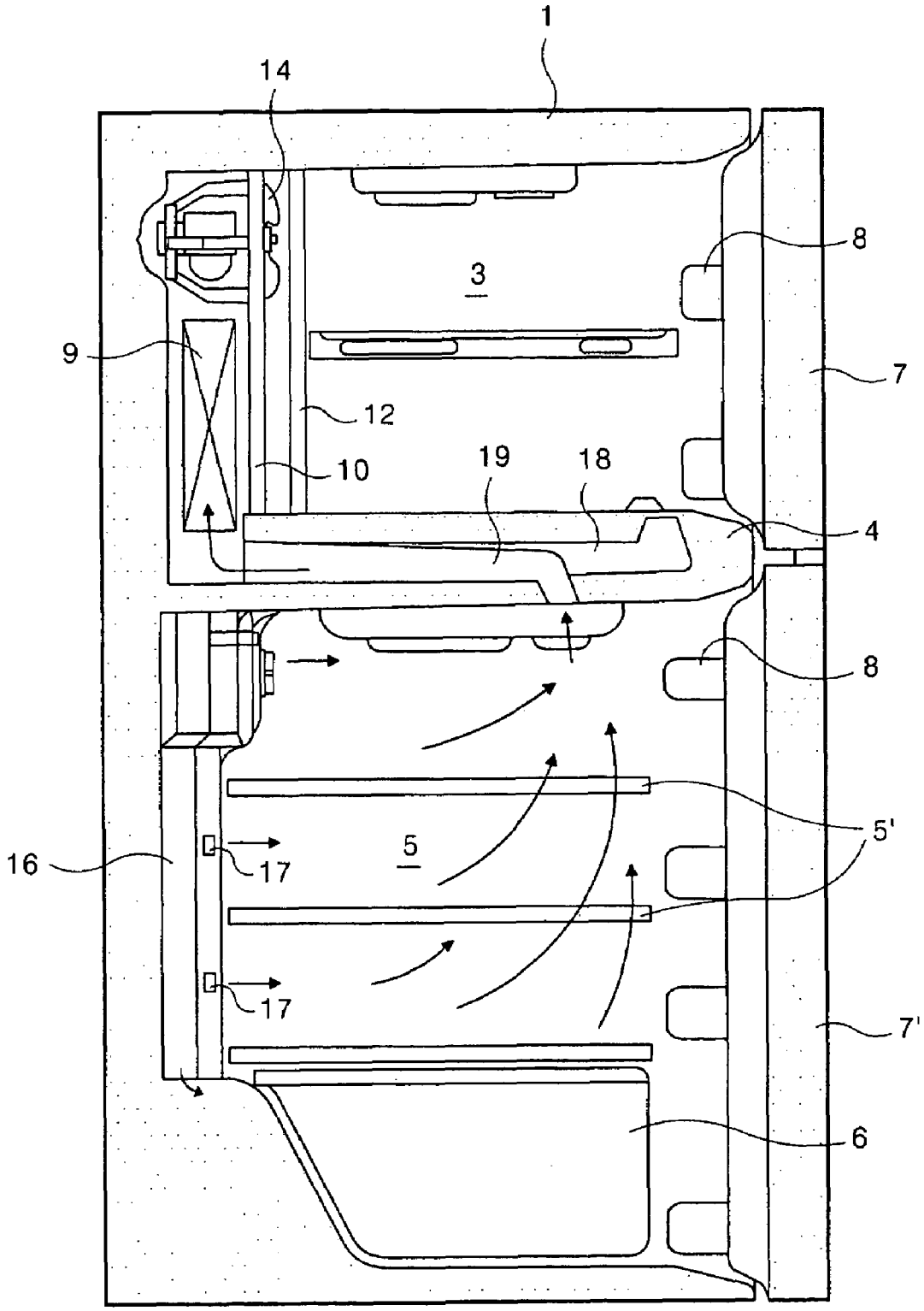
FIG. 6 CONVENTIONAL ART
FIG. 6 is a sectional view showing a conventional structure for a cold air circulation flow in a refrigerator.

Referring to FIG. 5, there is well shown that the temperature of the refrigerating chamber 35 according to the present invention is kept to be relatively uniform as time passes. The temperature of the compressor is plotted using a dotted line. The higher temperature of the compressor means that the refrigeration cycle is running. The temperature of the refrigerating chamber depending on the temperature of the compressor is plotted using a one-dotted chain line in case of the prior art and using a solid line in case of the present embodiment. As can be seen from this figure, in case of the present embodiment, the temperature deviation with the elapse of time is relatively small and thus the refrigerating chamber is kept at a substantially uniform temperature.

With the apparatus and method for controlling the cold air circulation in the refrigerator according to the present invention which have been described in detail above, the temperature of the entire refrigerating chamber can be kept to be uniform, and particularly, the vegetable storage chamber disposed at the lowermost portion of the refrigerating chamber and the lowermost door basket of the door can be maintained at a desired temperature.

Furthermore, according to the present invention, since the temperature of the entire refrigerating chamber can be kept to be uniform, the relatively low temperature cold air is prevented from being delivered to and heat-exchanged with the evaporator. Thus, the efficiency of the refrigerator can be improved.

Although the present invention has been described herein with respect to the preferred embodiments employed in an upright type refrigerator, it will be understood by those skilled in the art that the present invention can be employed in a parallel type refrigerator within the scope of the invention defined by the appended claims.

What is claimed is:

1. An apparatus for controlling cold air circulation in a refrigerator, comprising:

a cold air supply means for supplying cold air, which has been generated by a heat exchanger, to a storage space by using a blower fan, the storage space having an upper portion, a middle portion, and a lower portion;

a cold air supply flow passage with a plurality of cold air discharge ports corresponding to respective portions of the storage space so that the cold air supplied from the cold air supply means is delivered to the storage space;

a cold air return flow passage for returning the cold air, which has circulated in the storage space, to the heat exchanger by means of suction force of the blower fan;

a cold air circulation means comprising a circulation fan positioned at the lower portion of the storage space for causing the cold air, which has been supplied from the cold air supply flow passage to the storage space, to flow from the lower portion of the storage space only toward the lower or middle portion thereof; and a microcomputer for controlling the cold air supply means and the cold air circulation means based on information on temperature of the storage space so as to circulate the cold air in the refrigerator.

2. The apparatus as claimed in claim 1, wherein the cold air circulation means further comprises a circulation duct of which an inlet is disposed at the lower portion of the storage space and an outlet is disposed at the lower or middle portion of the storage space so as to deliver the cold air sucked by the circulation fan into the storage space again.

3. The apparatus as claimed in claim 2, wherein the circulation fan is installed at the outlet of the circulation duct.

4. The apparatus as claimed in claim 2, wherein the circulation fan is installed at the inlet of the circulation duct.

5. The apparatus as claimed in claim 2, wherein the cold air circulation means is installed within the cold air supply flow passage.

6. The apparatus as claimed in claim 2, wherein the cold air circulation means is installed at a side wall of the storage space which is separate from the cold air supply flow passage.

7. The apparatus as claimed in claim 2, wherein the outlet of the circulation duct is formed at the cold air discharge port of the cold air supply flow passage.

8. The apparatus as claimed in claim 7, wherein the inlet of the circulation duct is positioned at the lower portion of the storage space.

9. The apparatus as claimed in claim 8, wherein the inlet of the circulation duct is configured to communicate with a lower portion of an auxiliary storage chamber which is separately formed at the lower portion of the storage space.

10. A refrigerator comprising the apparatus of claim 1.

11. An apparatus for controlling cold air circulation in a refrigerator, comprising:

a cold air supply device configured to supply cold air to a storage compartment, the storage compartment having an upper portion, a middle portion, and a lower portion;

a cold air supply flow passage having one or more cold air discharge ports configured to deliver the cold air supplied from the cold air supply device to the respective portions of the storage compartment;

a cold air return flow passage configured to return the cold air, which has circulated in the storage compartment, to the cold air supply device; and a cold air circulation device comprising a circulation fan positioned in the lower portion of the storage compartment and configured to force cold air, which has been supplied from the cold air supply device, from the lower portion of the storage compartment only toward the lower or middle portion of the storage compartment.

12. The apparatus as claimed in claim 11, wherein the cold air circulation device is positioned adjacent an auxiliary storage compartment within the storage compartment and configured to supply the cold air, which has been supplied from the cold air supply flow passage, to the auxiliary storage compartment.

13. The apparatus as claimed in claim 12, wherein the auxiliary storage compartment is separately formed at the lower portion of the storage compartment.

14. The apparatus as claimed in claim 11, further comprising:

a microcomputer configured to control the cold air supply device and the cold air circulation device based on a temperature of the storage compartment.

15. The apparatus as claimed in claim 11, further comprising a blower fan configured to cause cold air to flow from the cold air supply device through the cold air supply flow passage into the storage compartment.

16. The apparatus as claimed in claim 11, wherein the cold air circulation device further comprises a circulation duct, an inlet of which is disposed adjacent to an auxiliary storage compartment positioned within the storage compartment.

17. The apparatus as claimed in claim 16, wherein the circulation fan is installed at the outlet of the circulation duct.

18. The apparatus as claimed in claim 16, wherein the circulation fan is installed at the inlet of the circulation duct.

19. The apparatus as claimed in claim 16, wherein the outlet of the circulation duct is formed adjacent one of the one or more cold air discharge ports.

20. The apparatus as claimed in claim 19, wherein the inlet of the circulation duct is positioned in the lower portion of the storage compartment.

21. The apparatus as claimed in claim 11, wherein the cold air circulation device is installed within the cold air supply flow passage.

22. The apparatus as claimed in claim 11, wherein the cold air circulation device is installed at a side wall of the storage compartment which is separate from the cold air supply flow passage.

23. A refrigerator comprising the apparatus of claim 11.

* * * * *